United States Patent [19]

Sommer

[11] Patent Number: 4,993,860

[45] Date of Patent: Feb. 19, 1991

[54] APPLYING DEVICE

[76] Inventor: Lothar Sommer, Kurlandstrasse 24, 8500 Nuremberg, Fed. Rep. of Germany

[21] Appl. No.: 49,777

[22] Filed: May 12, 1987

[30] Foreign Application Priority Data

May 13, 1986 [DE] Fed. Rep. of Germany ..... 3616116

[51] Int. Cl.[5] ..... B43K 7/10; A45D 34/04

[52] U.S. Cl. ..... 401/214; 401/209; 401/216

[58] Field of Search ..... 401/209, 214, 216

[56] References Cited

U.S. PATENT DOCUMENTS

| | | | |
|---|---|---|---|
| 1,194,347 | 8/1916 | Allen | 401/214 |
| 1,714,030 | 5/1929 | Boeuf | 401/214 X |
| 2,122,580 | 7/1938 | Morris | 401/214 |
| 2,228,540 | 1/1941 | Sturm | 401/214 X |
| 2,613,382 | 10/1952 | Patterson | 401/214 |
| 3,030,926 | 4/1962 | Sattmann | 401/214 |
| 3,379,490 | 4/1968 | Schwartzman | 401/214 |
| 3,537,801 | 11/1970 | Corte | 401/216 |
| 3,904,297 | 9/1975 | Hori | 401/216 |
| 4,139,313 | 2/1979 | Hori | 401/216 |
| 4,281,779 | 8/1981 | Shepard | 401/214 X |
| 4,572,691 | 2/1986 | Kirchloff et al. | 401/214 |

FOREIGN PATENT DOCUMENTS

| | | | |
|---|---|---|---|
| 1270447 | 6/1968 | Fed. Rep. of Germany | 401/214 |
| 2115043 | 10/1972 | Fed. Rep. of Germany | 401/216 |
| 2743888 | 4/1979 | Fed. Rep. of Germany | 401/216 |
| 1136563 | 12/1956 | France | 401/214 |
| 1559482 | 1/1969 | France | 401/216 |
| 609616 | 3/1979 | Italy | 401/209 |
| 221135 | 9/1967 | Sweden | 401/214 |
| 2073676 | 10/1981 | United Kingdom | 401/209 |

*Primary Examiner*—Steven A. Bratlie

*Attorney, Agent, or Firm*—Harness, Dickey & Pierce

[57] ABSTRACT

An applying device is described comprising a container 10 for liquid applying medium the filling opening 40 thereof is provided with an applying element 34. A ball 40 is located in the outlet opening 38 partially extending beyond the outlet opening. The outlet opening is connected to the internal space 20 of the reservoir 10 through a central hollow space 36. A spring element 48 located in the central hollow space 36 of the applying element 34 urges the ball 40 against the outlet opening for a closure thereof. The spring element 48 includes a rod-like portion 50 which is adapted to be laterally resiliently arched if a pressure is exerted on the ball. The rod-like portion 50 of the spring element 48 engages the ball 40 by an end portion. The opposite second end portion of the spring element 48 is secured in the central hollow space 36 of the applying element 34.

11 Claims, 1 Drawing Sheet

APPLYING DEVICE

BACKGROUND OF THE INVENTION

The invention refers to an applying device.

Such applying devices could be embodied as writing or painting devices, applying means for cosmetics or the like, the liquid applying medium being provided with a lower or higher viscosity in dependence on the application of the applying device. The liquid applying medium could include pigments, and its viscosity could be adjusted by a solvent. The applying medium could also be a varnish.

In an applying device of the kind mentioned above a spring element is defined by a coil spring engaging a ball within a central hollow chamber of the applying element. The coil spring has one end engaging the ball and its other end engaging the filling opening for the reservoir receiving the liquid applying means. An applying device with such a spring element has the disadvantage that the assembly of the applying device is relatively expensive due to the handling of the coil spring. A considerable disadvantage of such applying device can be seen in the fact that the central hollow space of the applying element wherein the spring element defined by a coil spring is located must not reach a predetermined minimum value in order to provide a space for the spring element. Due to the relatively large volume of the central hollow space in the applying element no capillary effect for the liquid applying medium is prevailing in the central hollow space. As a result, the liquid applying medium flows back from the central hollow space to the inner space of the reservoir after usage of the applying device and after turning the applying device in a vertical position. For this reason the liquid applying medium has to flow again from the interior of the reservoir to the central hollow space in the applying element and from there through the gap between the ball and the outlet opening before the next usage of the applying device. Because of the necessity of the flow of the liquid medium into the central hollow space of the applying element after a pressure against the ball has been exerted and the outlet opening is opened the liquid applying medium is discharged with delay. Due to the fact that the central hollow space of the applying element is not continuously completely filled with a liquid applying medium the danger occurs that the remaining thin liquid coating which is formed on the inner wall of the central hollow space of the applying element after usage of the applying device dries up. Further, the spring element in form of a coil spring is coated with a layer of liquid applying medium after usage of the applying device, and the layer dries up after a longer non-usage of the applying device. The dried liquid adversely affects the spring effect of the spring element.

Therefore it is an object of the invention to provide an applying device which is simply structured and can be simply assembled and which discharges the liquid applying medium within a reservoir at any time without delay.

SUMMARY OF THE INVENTION

This problem is solved by providing a capillary space.

By the provision of the capillary space the liquid applying medium is continuously discharged without time delay during use of the applying device, i.e. upon a pressure against the ball closing the outlet opening. The capillary space can be simply structured by the central body. By using the interspace between the central body and the inner wall of the central hollow space of the applying element to define a capillary space the liquid applying means does not flow back into the inner space of the reservoir after usage of the applying device. Rather, the interspace remains filled with the liquid applying medium so that upon a further usage of the applying device a predetermined amount of liquid applying medium is available at once to be discharged through the outlet opening upon opening the outlet opening. With such an applying device the flow of liquid applying medium is also not cut when the applying device is moved relatively rapidly along a ground because the liquid applying medium is fed through the outlet opening due to the capillary effect. By defining the mentioned interspace as capillary space wherein liquid applying medium is always contained, the danger of drying out the interspace and thus the danger of drying the portions adjacent the outlet opening of the applying element is reduced to a minimum. The central body can be defined as spring element having its front portion engaging the ball that closes the outlet opening of the applying element. By designing an applying device in such a manner the manufacturing and assembling costs are lower than with an applying device provided with a coil spring.

The spring element can include a rod-like portion which is laterally resiliently arched upon a pressure on the ball portion. The rod-like portion has its second end portion attached in the central hollow space of the applying element. By this structure the spring element can be arranged and secured within the central hollow space of the applying element before the applying element is assembled with the reservoir for the liquid applying medium. The spring element including a rod-like portion can be preferably made of plastic material with the resilient properties of the spring element being defined by the cross-sectional dimensions and by the length of the rod-like portion. Such a spring element is essentially more simply structured than a spring element in the form of a coil spring which normally is made of resilient metal.

The central hollow chamber within the applying element preferably includes a space for the ball. A portion joining to the ball receiving space has a smaller cross section and a main hollow space joining to this narrower portion and facing the reservoir. The rod-like portion extends through the narrow portion of the central hollow space of the applying element. The narrow portion of the central hollow space is preferably designed such that the rod-like portion of the spring element is not only designed to arch in the ball receiving space or in the main hollow space if a pressure is exerted on the ball but also along the narrow portion. The ball receiving chamber, the narrow portion and the main hollow chamber have such dimensions that they define a capillary space in conjunction with the spring element. The dimensions of the interspace defining a capillary space between the resilient element and the central hollow space are dependent on the liquid applying medium which is filled in the reservoir according to the invention. In an applying device according to the invention these dimensions are 0, 4 mm to the maximum for a correction liquid containing colour pigments. The last-mentioned dimension is the linear distance between an arbitrary point on the surface of the spring element and the inner wall of the central hollow space of the applying element. If this distance is larger than the mentioned value then the capillary effect for the correction liquid containing colour pigments and having a defined viscosity does not occur.

The portion of the central space including the narrow cross section is provided with recesses extending in the longitudinal direction of the applying element and connecting the ball receiving chamber with the main hollow chamber. Because of these recesses the narrow cross section of the central hollow space is provided with resilient properties so that the rod-like portion of the spring element may resiliently arch or be bent also in the range of the narrow portion upon a pressure against the ball. By this the rod-like portion of the spring element can be bent along its total length whereby good spring properties with an optimum spring constant for the spring element is achieved. This means that the ball can be pressed towards the reservoir with a relatively small pressure in order to relieve the outlet opening for the discharge of the liquid medium within the reservoir. The rod-like portion of the spring element may return to its straight initial position and the ball returns against the outlet opening to close the outlet opening when the ball is removed from the substratum or the like. The recesses can be defined as slots which form capillary spaces for the liquid applying medium. These slots can be open towards the center of the applying element so that they may extend radially from the portion of the central hollow space having the narrow cross section. The first end portion of the resiliently deformable rod-like portion of the spring element can include an enlargement for the support of the ball. By this design of the rod-like portion including the enlargement, a secure support for the ball on the rod-like portion is achieved and an effective centering of the ball relative to the rod-like portion and to the outlet opening of the applying element is obtained. A further advantage of the enlargement can be seen in the reduction of wear of the rod-like portion caused by rotation of the ball during the usage of the applying device so that the life of the applying device is further improved. The second end portion of the resiliently bendable rod-like portion of the spring element is preferably designed as retaining body which is provided with transverse ribs. The spring element being attached to the inner wall of the main hollow space of the applying element through the transverse ribs. The transverse ribs have dimensions with reference to the inner wall of the main hollow space of the central hollow space of the applying element such that a pressure seat is formed between the transverse ribs and the inner wall of the main hollow space. The spring element is slided or introduced in the central hollow space of the applying element until the retaining body is also within the main hollow space of the central hollow space of the applying element and jammed in the main hollow space by the transverse ribs. The retaining body of the spring element has such an axial dimension that it does not extend out of the main hollow space i.e. beyond the applying element. This is of particular advantage if the filling opening of the reservoir is provided with a known type of valve element. If the filling opening of the reservoir is not provided with a valve then the main body of the spring element may selectively extend beyond the applying element, i.e. extend out of the main hollow space of the central hollow space of the applying element towards the reservoir. By the provision of transverse ribs to the spring element a simple structure for the simply manufacturable spring element is achieved as well as a simplification of assembling of the spring element with the applying element saving time by simply inserting the spring element in the central hollow space.

The mouth piece is preferably mounted on the filling opening of the reservoir, the applying element including the outlet opening with the wall extending from the mouth piece, and a closure cap being preferably slipped on the mouth piece. The mouth piece, the applying element or the closure cap, respectively, can consist of score-safe plastic material, the mouth piece preferably having an internal thread by which the mouth piece can be threaded on a thread extension of the reservoir defining the filling opening of the reservoir.

According to an embodiment of the applying device of the invention, the applying element is fixedly connected to the mouth piece. The connection of the applying element with the mouth piece can be made by an adhesive. It is also possible to mold the mouth piece and the applying element integrally by injection molding. In such an applying device the filling opening of the reservoir for the liquid applying medium is not closed by a known valve. Rather the central hollow space of the applying element is always immediately in communication with the inner space of the reservoir.

According to another embodiment of the invention the filling opening of the reservoir is provided with a valve element for closing the reservoir, and the applying element is adapted to open the valve element by providing an axial displacement thereof relative to the mouth piece. In the applying device last-mentioned, the valve closing the filling opening or the reservoir is opened by the applying element being axially displaceable with respect to the mouth piece if the applying device is used. As already mentioned the main body of the spring element in this embodiment does not extend beyond the applying element so that the valve is solely opened by the axially displaceable applying element. Such a structure of the applying device including a valve closing the filling opening of the reservoir has the particular advantage that the storage properties of the applying device are considerably improved because the liquid applying medium is discharged through the valve in the central hollow space of the applying element and from there between the ball and the outlet opening to a substratum or the like not before the first usage of the applying device. This is particularly advantageous if the liquid applying medium affects the material of the applying element and/or the material of the spring element.

BRIEF DESCRIPTION OF THE DRAWINGS

Further details, features and advantages turn out of the description hereinafter of two examples of the applying device according to the invention illustrated by drawings. It shows.

DETAILED DESCRIPTION OF THE PREFERRED EMBODIMENTS OF THE INVENTION

Figure 1:
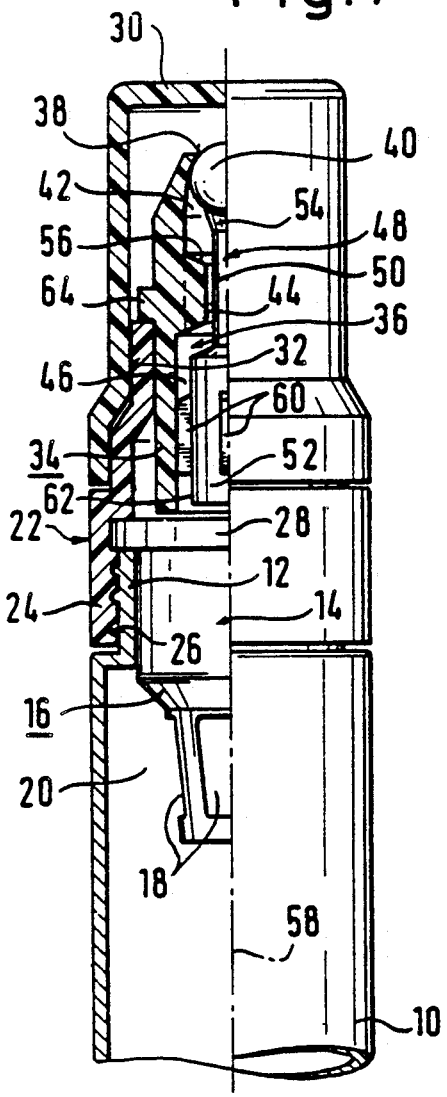
FIG. 1 a side view of an applying device one half thereof in cross section wherein the reservoir for the liquid applying medium is only partially shown, FIG. 2 a side view of a second embodiment of an applying device one half thereof being in cross section wherein the reservoir for the liquid applying medium is only partially illustrated, the filling opening of the reservoir being provided with a known valve, FIG. 3 a cross section along the line III—III of FIG. 2, and FIG. 4 a cross section along line IV—IV of FIG. 2.

FIG. 1 shows a partially illustrated reservoir 10 or container for liquid applying medium. The reservoir 10 consists for instance of aluminum sheet and includes a threaded extension 12 which defines the filling opening 14 through which liquid applying medium is filled into the reservoir 10. The housing 16 of a known valve is inserted in the filling opening 14 of the reservoir 10. The housing 16 has openings 18 through which the inner space 20 of the reservoir is in communication with the filling opening 14. A mouth piece 22 is connected to the reservoir 10 which mouthpiece is for instance made of score-safe plastic material. The mouth piece 22 includes a portion 24 having an internal thread 26 which corresponds to the thread on the threaded extension 12. The mouth piece 22 with its portion 24 is threaded on the threaded extension 12 such that the housing 16 with its circumferentially extending flange 28 is axially secured between the threaded extension 12 and the mouth piece 22. The outer contour of the mouth piece 22 and the inner contour of a closure cap 30 correspond to each other so that the closure cap 30 can be slipped onto the mouth piece 22 in order to close the applying device.

The sleeve-like mouth piece 22 includes a central opening 32 wherein an applying element 34 is attached. The applying element 34 includes a central hollow space 36 and an outlet opening 38 which is sealingly closed by a ball 40. The central hollow space 36 of the applying element 34 includes a ball receiving chamber 42, a portion 44 of smaller cross section joining the ball receiving space 42 and a main hollow space 46. The main hollow space 46 joins with the portion 44 and faces the reservoir 10. A spring element 48 is located within the central hollow space 36 of the applying element 34, the spring element 48 including a rod-like portion 50 and a retaining body 52. The retaining body 52 is located at the second end portion of the rod-like portion 50 which faces the reservoir 10. The first end portion of the rod-like resiliently bendable portion 50 is provided with an enlargement 54 by which the rod-like portion 50 engages the ball 40. By the enlargement 54 the pressure per area unit by which the ball 40 urges against the rod-like portion 50 during the usage of the applying device is reduced so that the wear of the first end portion of the rod-like portion 50 is reduced. Further the ball receiving space 42 is reduced due to the enlargement 54 whereby the capillary effect in the ball receiving space 42 is improved. The portion 44 with narrow cross-sectional area is provided with recesses 56 which are star-shaped with respect to the longitudinal center line 58 of the applying device. The slot-like recesses 56, the annular space between the rod-like portion 50 and the portion 44 having the narrow cross-sectional area have such dimensions that they form a capillary space as is the case with the ball receiving space 42 for the applying medium within the reservoir 10. By the slots or recesses 56 the ball receiving space 42 is in communication with the main hollow space 46 of the central hollow space 36 of the applying element 34.

The spring element 48 is connected to the applying element 34 by transverse ribs 60 which radially extend from the main body 52 of the spring element 48. The main body 52 is inserted with its transverse ribs 60 in the main hollow space 46 whereby the transverse ribs 60 are jammed at the inner wall 62 of the main hollow space 46 forming a pressure seat. The main body 52 has a dimension with respect to the inner wall 62 of the main hollow space 46 such that the tube-like space between the applying element 34 and the main body 52 of the spring element 48 also defines a capillary space. Due to the fact that the spaces 42, 44, 36 and 46 are defined as capillary spaces these spaces remain filled with liquid applying medium even if the applying device is in a vertical position as illustrated. By this not only a drying of the applying device after a longer non-usage is prevented but also the liquid applying medium is discharged through the outlet opening 38 of the applying element along the ball 40 immediately after the use of the applying device.

In use of the applying device the closure cap 30 is removed from the mouth piece 22, and the applying device is pressed against a substratum e.g. a blotting pad with its ball 40 so that the ball 40 moves a small extent towards the reservoir 10. By this the rod-like portion 50 of the spring element 48 is laterally bent out of the position in alignment with the central longitudinal axis 58 because the main body 52 of the spring element 48 is axially secured with respect to the applying element 34. As soon as the applying device is removed from the ground the rod-like portion 50 of the spring element 48 is mechanically relieved whereby the rod-like portion 50 returns to the straight position as shown, and presses the ball 40 again against the outlet opening 38 so that the outlet opening 38 is sealingly closed by the ball 40.

64 defines an annular extension molded to the applying element 34 by which the applying element 34 engages the mouth piece 22.

Figure 2:
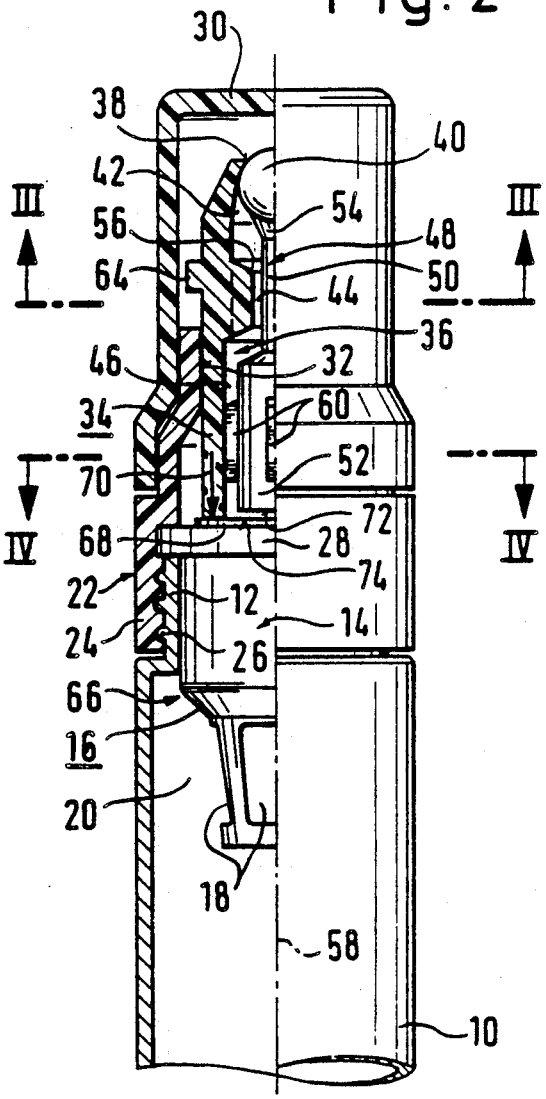

FIG. 2 shows a second embodiment of an applying device; the reservoir 10 for the liquid applying medium thereof is only partially shown. 22 designates a mouth piece which has a portion 24 including an internal thread by which it may be threaded on a threaded extension 12 of the container 10. A closure cap 30 is slipped on the mouth piece 22. The filling opening 14 defined by the threaded extension 12 of the container 10 is closed by a known valve 66, the housing 16 thereof being axially secured by an annular radial extension 28 between the threaded extension 12 of the container 10 and the mouth piece 22. 68 designates a valve actuating element by means of which the valve 66 can be opened in order to establish a communication between the inner space 20 of the container 10 to the central hollow space 36 of the applying element 34 through the openings 18 in the valve housing 16.

In order to open valve 66 it is necessary that the valve actuating element 68 is pressed in the direction of arrow 70 against the valve housing 16 or the reservoir 10, respectively. This is achieved by an axial displacement of the applying element 34 which to this purpose is axially displaceably located in the central opening 32 of the mouth piece 22. An extension 64 annularly surrounding the applying element 34 serves for limiting the displacement of the applying element 34. The central hollow space 36 of the applying element 34—in correspondence with the applying device according to FIG. 1—is divided into a ball receiving space 42, a portion 44 of narrow cross-sectional area and a main hollow space 46. The spring element 48 includes a rod-like portion 50 and a main portion 52 which is provided with transverse ribs 60. By ribs 60 the main body 52 of the spring element 48 is jammed in the main hollow space 46 of the applying element 34 and secured against axial movement.

In order to avoid with this embodiment that the valve actuating element 68 is solely actuated by the applying element 34 without an axial movement of the spring element 48 with respect to the applying element 34 it is necessary that the end face 72 of the main body 52 does not extend beyond the annular base surface 74 of the applying element towards the container 10. 54 designates the enlargement of the rod-like portion 50 which is engaged by the ball 40 closing the outlet opening 38. 56 designates recesses which extend longitudinally of the portion 44 having the narrow cross section and establishing a communication of the ball receiving space 42 with the main hollow space 46.

As in the embodiment of FIG. 1 the ball receiving space 42, the portion 44 of narrow cross section, the recesses 56 and the main hollow space 46 of the central hollow space 36 of the applying device 34 and the spring element 48 including the rod-like resiliently bendable portion 50 and the main body 52, respectively, have such dimensions that the hollow space between the applying element 34 and the spring element 48 defines a capillary space. The liquid applying medium is also stored in this capillary space when the applying device after usage is brought to an upright position as shown. By this a drying up of the mentioned capillary space is avoided so that upon a reusage of the applying device the amount of liquid applying medium stored in the capillary space is immediately available to be applied to a substratum. During the usage of the applying device also sufficient liquid applying medium is fed by the capillary effect so that an uninterrupted application of the liquid applying medium through the outlet opening 36 is obtained if the ball 40 is pressed against the substratum. The ball 40 can be made of metal or plastic material, the surface thereof having a predetermined roughness. A slightly roughened ball surface causes a rotation of the ball during the usage of the applying device whereby the feed of liquid applying medium from the capillary space through the outlet opening 36 is supported.

Figure 3:
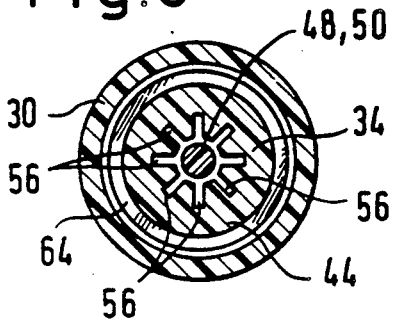

FIG. 3 shows the rod-like portion 50 of the spring element 48 in cross section as well as portion 44 of the applying element 34 having a reduced cross section. Also the recesses 56 can be clearly seen in this Figure which are positioned in a star-like arrangement with respect to the rod-like portion 50 of the spring element 48 and are uniformly distributed. 30 is a closure cap of the applying device.

Figure 4:
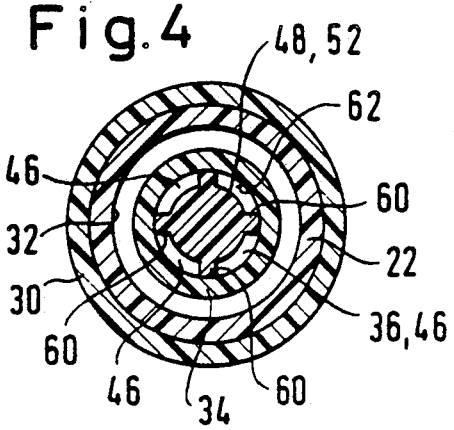

FIG. 4 shows a cross section through the retaining body 52 of the spring element 48. Radial transverse ribs 60 extend from the retaining body 52 by which the retaining body 52 is jammingly secured in the main hollow space 56 of the central hollow space 36 of the applying element 34. 22 designates a mouth piece having a central bore 32 allowing an axial displacement of the applying element 34, i.e. perpendicularly to the drawing plane. 30 designates also in this Figure the closure cap.

According to a further development of the applying device of the invention the pin-like portion 50 terminates at a distance from ball 40, i.e. without contacting ball 40. By this embodiment of the applying device the pin-like portion 50 does not need an enlargement 54. The pin-like portion 50 is surrounded by a coil spring which resiliently engages the ball 40 with one end portion thereof. The second end portion of the coil spring engages the main body 52 of the central body 58. In this case, the central body 58 is not a resilient element but a body by which the capillary space 36 is precisely confined. On the other side the capillary space 36 is confined by the inner contour of the central hollow space of the applying element 34. The central hollow space in this embodiment according to the invention can also provide a ball receiving space 42, a portion 44 with reduced cross section and a main hollow space 46. The last-mentioned embodiment secures a more uniform flow of liquid applying medium through the capillary space 36 and through the outlet opening 38 than in the case of the one-sided arching of the spring element 48 having a rod-like portion 50 engaging ball 40. Since the spring element in form of a coil spring is slipped onto the rod-like portion 50 of the central body 48 prior to the central body 48 being secured in the central hollow space 36 of the applying device 34 the assembling of the applying device according to the invention is also more simply than with known applying devices.

I claim:

1. An applying device comprising a reservoir for a liquid medium, having a filling opening through which said reservoir may be filled with the liquid medium and provided with an applying element having an outlet opening connected to the interior of the reservoir through a central hollow space, a ball located in the outlet opening and moveable from a closed position wherein said ball partially extends beyond the outlet opening, and spring means within the central space of the applying element exerting a pressure to the ball urging the ball to a closed position against the outlet opening for a closure thereof and for preventing the discharge of said liquid medium, characterized in that in said central hollow space of the applying element a resilient central body functioning as said spring means is located which defines a capillary space for the liquid medium in the reservoir between the central body and the outer limit of the hollow space, said spring means being yieldable upon the application of a force to said ball for permitting said ball to move from said closed position to an open position spaced from said outlet opening for flow of liquid through said capillary space and said outlet opening for application thereof.

2. The applying device according to claim 1, characterized in that a front end of the central body engaging the ball of the applying element.

3. The applying device according to claim 2, characterized in that the central body includes a rod-like portion adapted to be laterally resiliently bent upon a pressure on the ball, the rod-like portion being attached in the central hollow space of the applying element by a second end portion.

4. The applying device according to claim 3, characterized in that the central hollow space of the applying element includes a ball receiving space for the ball, a portion joining the ball receiving space and having a reduced cross section, and a main hollow space joining the portion and facing the reservoir, the rod-like portion extending through the portion of reduced inner diameter of the central hollow portion of the applying element.

5. The applying device according to claim 4, characterized in that the portion of reduced cross section in the central hollow space includes recesses extending in longitudinal direction of the applying element and interconnecting the ball receiving space and the main hollow space.

6. The applying device according to claim 5, characterized in that the recesses are formed as slots which define capillary spaces for the liquid applying medium.

7. The applying device according to claim 4, characterized in that the first end portion of the resiliently deformable rod-like portion of the spring element includes an enlargement for the support of ball.

8. The applying device according to claim 4, characterized in that the second end portion of the resiliently deformable rod-like portion of the spring element is formed as retaining body including radial ribs, the spring element being secured to the inner wall of the main hollow space of the applying element by the radial ribs of the retaining body.

9. The applying device according to claim 1, characterized in that a mouth piece is located on the filling opening of the container, the applying element and the ball and the outlet opening extending from the filling opening and a closure cap detachably placed on the mouth piece.

10. The applying device according to claim 9, characterized in that the applying element is fixedly connected to the mouth piece.

11. The applying device according to claim 9, characterized in that the filling opening of the container is provided with a valve element for the closure of the container and the applying element can be axially displaced with respect to the mouth piece for the opening of the valve element.

* * * * *